US009011088B2

(12) United States Patent
Lehmann

(10) Patent No.: US 9,011,088 B2
(45) Date of Patent: Apr. 21, 2015

(54) PIVOTABLE PROPELLER NOZZLE FOR A WATERCRAFT

(75) Inventor: Dirk Lehmann, Winsen/Luhe (DE)

(73) Assignee: Becker Marine Systems GmbH & Co. KG, Hamburg (DE)

( * ) Notice: Subject to any disclaimer, the term of this patent is extended or adjusted under 35 U.S.C. 154(b) by 272 days.

(21) Appl. No.: 13/378,435

(22) PCT Filed: Feb. 22, 2011

(86) PCT No.: PCT/EP2011/052599

§ 371 (c)(1),
(2), (4) Date: Dec. 15, 2011

(87) PCT Pub. No.: WO2011/101489

PCT Pub. Date: Aug. 25, 2011

(65) Prior Publication Data

US 2012/0308382 A1 Dec. 6, 2012

(30) Foreign Application Priority Data

Feb. 22, 2010 (DE) ..... 10 2010 002 213
May 28, 2010 (DE) ..... 10 2010 029 430

(51) Int. Cl.

| | |
|---|---|
| ***B63H 5/15*** | (2006.01) |
| ***B63H 25/34*** | (2006.01) |
| *B63B 3/40* | (2006.01) |
| *B63H 25/46* | (2006.01) |

(52) U.S. Cl.

CPC ... *B63H 5/15* (2013.01); *B63B 3/40* (2013.01); *B63H 25/34* (2013.01); *B63H 25/46* (2013.01)

(58) Field of Classification Search

CPC ..... B63H 25/38; B63H 5/14; B63H 5/125
USPC ..... 440/66, 67, 71, 72, 79; 114/162, 169; 415/126, 211.2, 227, 228; 416/189
See application file for complete search history.

(56) References Cited

U.S. PATENT DOCUMENTS

| | | | | | |
|---|---|---|---|---|---|
| 123,629 | A | * | 2/1872 | Hemje | 114/165 |
| 313,733 | A | * | 3/1885 | Heydt | 114/166 |
| 899,359 | A | * | 9/1908 | Wadagaki | 440/67 |
| 1,306,913 | A | * | 6/1919 | Kitchen | 114/145 R |
| 1,805,597 | A | | 5/1931 | Pratt | |
| 2,139,594 | A | * | 12/1938 | Kort | 114/166 |
| 2,483,675 | A | * | 10/1949 | Sheldon | 114/166 |
| 2,800,150 | A | * | 7/1957 | Farwell, Sr. | 114/166 |
| 3,082,728 | A | * | 3/1963 | Dawes | 114/166 |
| 3,179,081 | A | | 4/1965 | Backhaus et al. | |
| 3,499,412 | A | | 3/1970 | Anthes et al. | |
| 3,899,992 | A | * | 8/1975 | Fuller | 440/51 |
| 4,493,660 | A | | 1/1985 | Becker et al. | |

(Continued)

FOREIGN PATENT DOCUMENTS

| | | |
|---|---|---|
| AT | 362 250 B | 4/1981 |
| CN | 101434292 A | 5/2009 |

(Continued)

*Primary Examiner* — Nathaniel Wiehe
*Assistant Examiner* — Eldon Brockman
(74) *Attorney, Agent, or Firm* — Kelly & Kelley, LLP

(57) ABSTRACT

A propeller nozzle for watercraft includes a stationary propeller and a nozzle ring that shrouds the propeller and can be pivoted by means of a nozzle shaft. The nozzle shaft is provided in the form of a hollow body in order to achieve a constructively simple and simultaneously stable connection between the nozzle shaft and the nozzle ring.

17 Claims, 5 Drawing Sheets

(56) References Cited

U.S. PATENT DOCUMENTS

Figure 1:
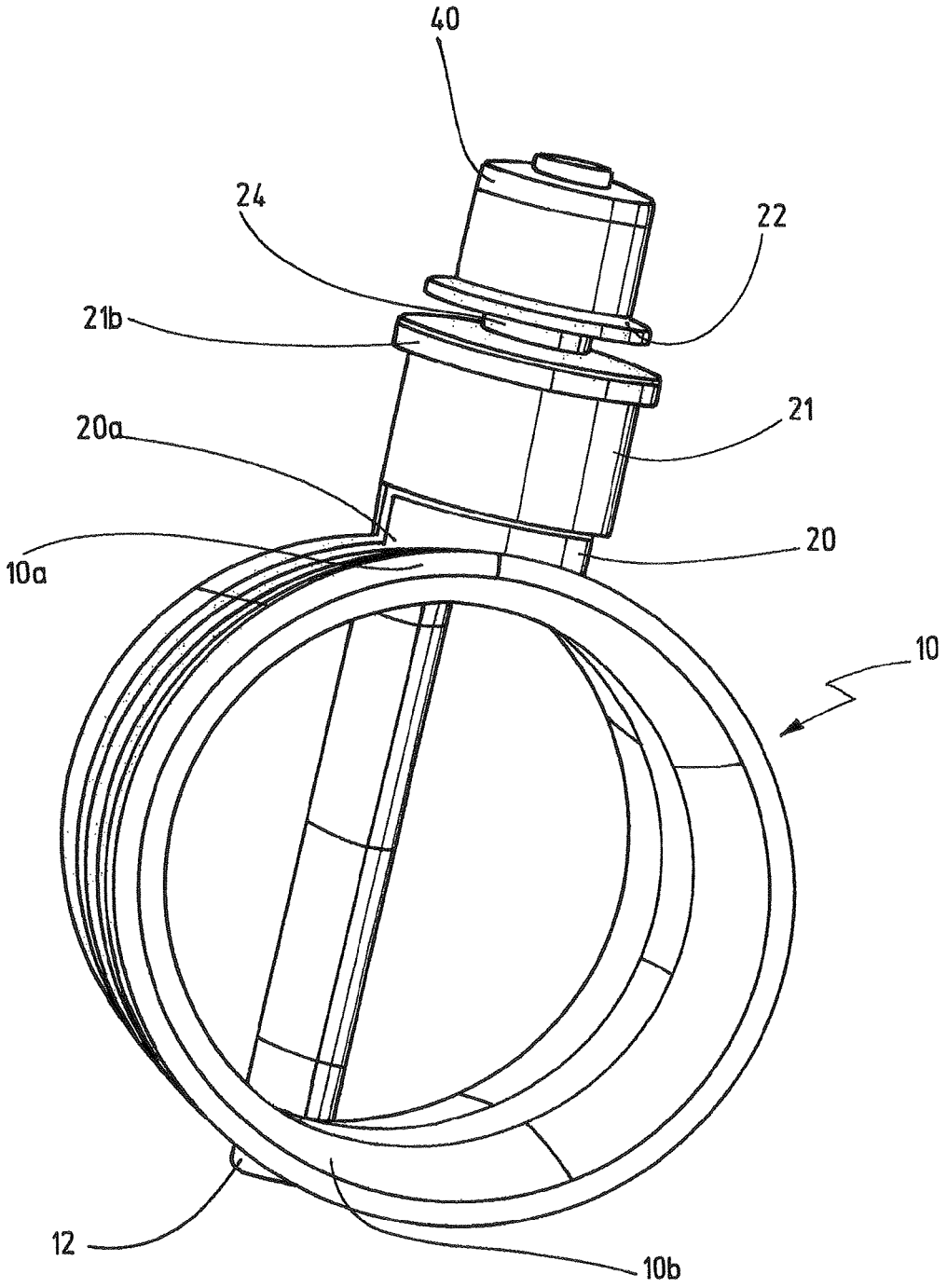

| | | | | |
|---|---|---|---|---|
| 4,773,347 | A * | 9/1988 | Winterbottom | 114/166 |
| 7,591,230 | B2 * | 9/2009 | Kluge et al. | 114/162 |
| 2004/0134403 | A1 | 7/2004 | Moneuse | |
| 2006/0222526 | A1 | 10/2006 | Seiford, Sr. | |
| 2009/0130927 | A1 * | 5/2009 | Kluge | 440/67 |

FOREIGN PATENT DOCUMENTS

| | | | |
|---|---|---|---|
| DE | 966 830 | B | 9/1957 |
| DE | 10 18 741 | B | 10/1957 |
| DE | 1 110 041 | A | 6/1961 |
| DE | 1 129 856 | A | 5/1962 |
| DE | 2 246 766 | A1 | 3/1974 |
| DE | 8422089 | U1 | 10/1984 |
| DE | 8713479 | U1 | 12/1987 |
| GB | 1 202 873 | A | 8/1970 |
| JP | S62-013799 | U | 1/1987 |
| JP | H07-008198 | U | 2/1995 |
| JP | 2003-191895 | A | 9/2003 |
| JP | 2009-120169 | A | 4/2009 |

* cited by examiner

Prior Art

PIVOTABLE PROPELLER NOZZLE FOR A WATERCRAFT

The present invention pertains to a pivotable propeller nozzle for watercraft, as well as to a nozzle shaft for pivoting the propeller nozzle for watercraft.

The term propeller nozzle refers to propulsion units of watercraft, particularly of ships, with a propeller that is surrounded or shrouded by a nozzle ring. Nozzle rings of this type are also referred to as "Kort nozzles." In this case, the propeller arranged in the interior of the nozzle ring is normally realized stationary, i.e., the propeller can only be pivoted about the drive or propeller axis. For this purpose, the propeller is connected to the hull by means of a rotatable, non-pivotable propeller shaft that extends along the propeller axis. The propeller shaft is driven by a drive arranged in the hull. The propeller, in contrast, is not (horizontally or vertically) pivotable.

In simply designed propeller nozzles, the nozzle ring surrounding the propeller is also stationary, i.e., non-pivotable, and has the sole function of increasing the thrust of the propulsion system. Propeller nozzles of this type therefore are frequently used in tugboats, supply vessels and the like that respectively need to generate high thrust. In order to steer a ship or watercraft featuring such a propeller nozzle with stationary nozzle ring, an additional steering arrangement, particularly a rudder, needs to be arranged downstream of the propeller, i.e., behind the propeller nozzle referred to the moving direction of the ship.

The present invention, in contrast, exclusively pertains to pivotable propeller nozzles and, in particular, pivotable propeller nozzles of the type featuring a stationary propeller and a nozzle ring that can be pivoted around the stationary propeller. Such a pivotable nozzle ring not only increases the thrust of the watercraft, but the propeller nozzle can be simultaneously used for steering the watercraft and therefore replace or eliminate the need for additional steering systems such as rudders. The direction of the propeller outflow can be changed and the ship can therefore be steered by pivoting the nozzle ring about the pivoting axis that normally extends vertically in the installed state. This is the reason why pivotable propeller nozzles are also referred to as "steering nozzles." In the installed state, the nozzle ring can normally be pivoted along a horizontal plane or about a vertical axis, respectively. In the present context, the term "pivotable" refers to the nozzle ring being pivotable starboard, as well as portside, from its starting position by a predetermined angle, but not completely rotatable by 360°.

In this case, the nozzle ring or the Kort nozzle usually consists of a conically tapered pipe that preferably is realized rotationally symmetrical and forms the wall of the nozzle ring. Due to the taper of the pipe toward the stern of the vessel, the propeller nozzles can transmit additional thrust to the watercraft without having to increase the performance. In addition to the propulsion-improving properties, this furthermore reduces pitching motions in rough sea such that lost motion can be reduced and the directional stability can be improved in heavy sea. Since the inherent resistance of the propeller nozzle or a Kort nozzle increases about quadratically as the speed of the ship increases, its advantages can be utilized in a particularly effective fashion in slow ships that need to generate high propeller thrust (tugboats, fishing boats, etc.).

In pivotable propeller nozzles known from the state of the art, bearings are respectively provided on the upper side and the underside of the nozzle ring, namely on the outer side of its wall, in order to realize the pivoted support thereof. On the upper side, the support is realized with a shaft, namely the so-called nozzle shaft that is usually flanged on and in turn connected to a pivot drive or a steering gear in the watercraft. This nozzle shaft or rotary shaft transmits the torque required for steering to the nozzle ring, i.e., the propeller nozzle can be pivoted by means of the nozzle shaft. On the underside, in contrast, a simple support in the form of a vertical journal is realized and allows a pivoting motion about the pivoting axis or vertical axis. Lower support arrangements of this type are also referred to as a "support in the sole piece." The nozzle ring normally can be pivoted toward both sides by approximately 30° to 35°.

Figure 6:
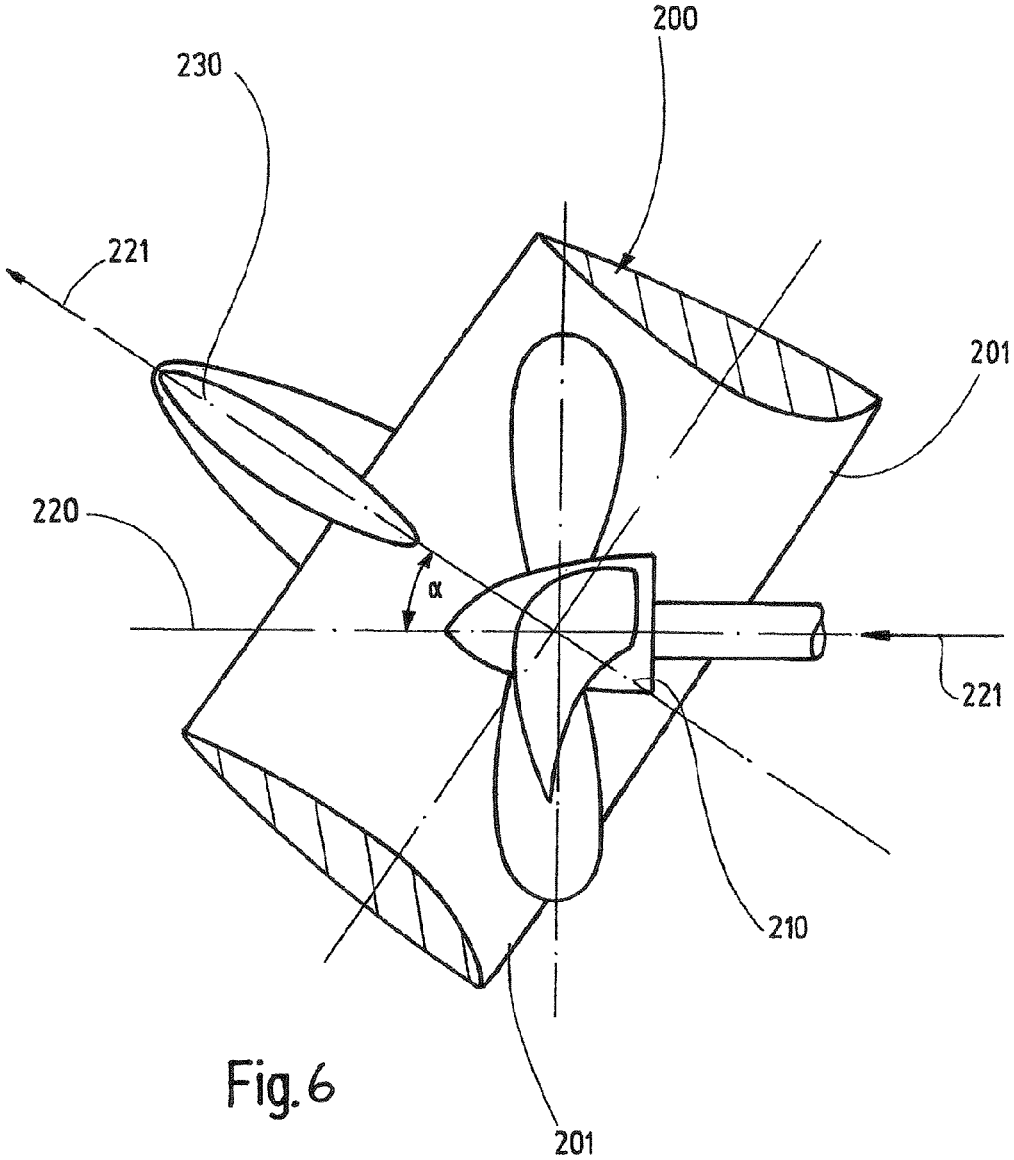

FIG. 6 shows an exemplary embodiment of a Kort nozzle 200 according to the state of the art that can be pivoted about the rudder axis of a vessel and features a stationary propeller arranged therein. The Kort nozzle 200 is arranged around the stationary propeller 210 of a (not-shown) vessel. In this figure, the Kort nozzle is pivoted about the longitudinal axis 220 of the vessel by an angle $\alpha$ of approximately 30°. The arrow 221 represents the flow direction of the ocean or sea water. A stationary fin 230 is provided on the Kort nozzle 200 downstream of the propeller referred to the flow direction in order to positively influence the steering power of the Kort steering nozzle. The nozzle profile is chosen such that the intake region 201 of the Kort nozzle 200 (referred to the direction of the flow through the Kort nozzle 200) is widened. This means that the inside diameter of the intake region is larger than the inside diameter in any other region of the Kort nozzle 200. In this way, the water flow through the Kort nozzle 200 and toward the propeller 210 is increased and the propulsion efficiency of the Kort nozzle is improved.

The nozzle shaft of known pivotable propeller nozzles is realized in the form of a cylindrical shaft with solid cross section that normally has a diameter of approximately 250 mm and is connected to the nozzle ring on its end region by means of flange plates or the like. For this purpose, a corresponding counterpart, i.e., a flange plate and additional reinforcements or the like, needs to be arranged on the outer wall of the nozzle ring or formed of the wall material of the nozzle ring. This reinforcement and elaborate flanging with reinforcing plate is necessary because significant problems could otherwise arise at the interface between the relatively thin, massive shaft and the hollow body of the nozzle ring with its relatively thin profile and the connection could become unstable.

It is therefore the objective of the present invention to disclose a propeller nozzle, in which the connection between the nozzle shaft and the nozzle ring is constructively simplified, as well as realized in a torsionally rigid fashion and able to withstand high bending moments.

This objective is attained with a nozzle shaft with the characteristics of claim 1 and with a propeller nozzle with the characteristics of claim 7.

According to the present invention, the nozzle shaft of the pivotable propeller nozzle, about which the propeller nozzle pivots, is realized in the form of a hollow body or hollow cylinder, particularly in the form of a cylindrical pipe. The hollow body preferably has a constant diameter over its entire length in the axial direction, i.e., along the pivoting axis. However, the hollow body could, in principle, also be realized conically or stepped with several successive sections of different diameter or similarly. It was nevertheless determined that the straight design with constant diameter represents the version that can be manufactured most easily and is most favorable with respect to torsional and bending stresses. The nozzle shaft realized in the form of a hollow body makes it possible to pivot the nozzle ring that is arranged around and shrouds the stationary propeller of the propeller nozzle.

In contrast to the present invention, the nozzle shaft was until now always realized massively, particularly of forged steel. These massive nozzle shafts with solid cross section have a relatively small diameter because they would otherwise be excessively heavy. The relatively small diameter results in the initially mentioned problems in the connection between the nozzle shaft and the thin-walled nozzle ring.

Unlike the massive nozzle shafts known from the state of the art, the nozzle shaft in the form of a hollow cylinder has a significantly larger diameter. The diameter is, in particular, at least twice as large as that of conventional massive nozzle shafts known from the state of the art. The hollow cylinder has a diameter in the range between 600 mm and 1500 mm, preferably 750 mm to 1250 mm, particularly 900 mm to 1100 mm. The cited ranges usually refer to the outside diameter of the nozzle shaft. However, the inside diameter could, in principle, also lie within the cited ranges. In this respect, it is advantageous that the large diameter of the hollow cylinder makes it possible to achieve a very high torsional rigidity and to furthermore absorb high bending moments. This is realized with less material input than that required for massive nozzle shafts. The interface or the connection between the nozzle shaft and the nozzle ring can furthermore be realized in a much more stable and simpler fashion. Due to the larger diameter, the forces engaging in the connecting region are distributed over a larger area such that it is not necessary to provide special reinforcements such as the reinforcing plates or similar elements used on conventional propeller nozzles. All in all, the present invention proposes a propeller nozzle that respectively has an improved torsional rigidity and can absorb higher bending moments and simultaneously has a simple construction, particularly in the connecting region between the nozzle shaft and the nozzle ring.

Alternatively or additionally to the above-cited dimensions for the nozzle shaft diameter, the wall thickness of the hollow cylinder lies between 10 mm and 100 mm, preferably 20 mm to 80 mm, particularly 30 mm to 50 mm. Calculations and tests carried out by the applicant have shown that particularly favorable results with respect to the torsional rigidity and the connection to the nozzle ring can be achieved and that the material input required for the manufacture of the nozzle shaft can be simultaneously maintained as low as possible if the diameter and the wall thickness of the nozzle shaft respectively lie in the above-cited ranges.

The hollow body or the hollow cylinder is preferably manufactured of steel. In this case, the hollow cylinder may be realized, in particular, in the form of a steel pipe. In this way, a particularly simple construction of the nozzle shaft is achieved. If it does not have a stepped or conical design, the hollow cylinder preferably has a constant wall thickness over its entire length.

The nozzle shaft may be advantageously realized in one piece, i.e., it may comprise a single pipe that is fixed to a nozzle ring of a propeller nozzle with one end and to a pivot drive with the other end.

The end region of the nozzle shaft that lies opposite of the nozzle ring is preferably realized in such a way that it can be connected to a pivot drive arranged in the interior of the watercraft, particularly a steering gear, in order to transmit a torque. In one particularly preferred embodiment, the end region is realized such that it can receive a pivot drive for the nozzle shaft. This means that the pivot drive for the nozzle shaft is at least partially arranged in the interior of the nozzle shaft, i.e., in its hollow space. In this respect, it is advantageous if the outside dimensions of the pivot drive essentially correspond to the inside dimensions of the hollow cylinder such that the pivot drive can be inserted flush into the hollow cylinder. Accordingly, the pivot drive preferably has a circular cross section and its outside diameter essentially corresponds to the inside diameter of the nozzle shaft. In this way, the entire steering system can be realized in an altogether more compact fashion because the pivot drive is now arranged in the nozzle shaft such that a separate space for the pivot drive is no longer required within the hull. The assembly is also simplified because the nozzle shaft and the pivot drive can be supplied in the form of a module into directly installed. Corresponding mounting means need to be provided in order to mount the pivot drive. The pivot drive may be mounted directly on the nozzle shaft or on the hull, for example, by means of a flange or the like on the end of the nozzle shaft. It is particularly advantageous to realize the pivot drive in the form of a blade-type drive unit or blade-type steering gear. Such a pivot drive has a compact design and therefore is particularly suitable for being inserted into the nozzle shaft.

The nozzle shaft furthermore may advantageously feature connecting means for connecting the nozzle shaft to a pivot drive normally arranged in a watercraft hull, particularly a blade-type drive unit or the like, on one of its two end regions. The nozzle shaft may, in principle, be realized integrally with the connecting means. However, the connecting means preferably are detachably arranged in the end region of the nozzle shaft, particularly by means of a screw connection. The connecting means may comprise, in particular, an arbor, a shaft stub or the like that is designed for being inserted into a corresponding counterpart of a pivot drive and transmits the torque from the pivot drive to the nozzle shaft.

The connecting means may furthermore comprise an axial bearing that supports the nozzle shaft in the axial direction. The axial support may be realized, for example, with a suitably designed mounting flange that is arranged on the end face of the nozzle shaft. The flange furthermore may be realized integrally with the arbor or shaft stub.

The end region of the nozzle shaft that faces the nozzle ring is rigidly connected to the nozzle ring. It is particularly preferred to produce this connection by means of welding. In the state of the art, in contrast, the massive nozzle shafts are detachably bolted to the nozzle ring by means of flange plates or the like. Due to the small diameter of known massive nozzle shafts, as well as the required detachability of the nozzle shafts, a welded connection or other rigid connection could not be used until now. The inventive propeller nozzle preferably has compact dimensions such that it can be detached at the dock.

In order to produce the rigid connection, the end region of the nozzle shaft that faces the nozzle ring is furthermore extended into the nozzle ring, i.e., into the nozzle body, particularly up to the inner nozzle profile region. In other words, the nozzle shaft does not simply contact the outer surface of the nozzle ring, but is inserted into the structure of the nozzle ring, i.e., into its interior. The nozzle shaft is inserted into the wall of the nozzle ring in such a way that a section of the end region of the nozzle shaft that faces the nozzle ring is arranged in the interior of the nozzle ring with its complete nozzle shaft diameter. In other words, the entire end face of the nozzle shaft is completely incorporated into the nozzle ring wall. It is advantageous if the length of the nozzle shaft section inserted into the nozzle ring amounts to at least 25%, preferably at least 50%, particularly at least 75% of the nozzle ring thickness, i.e., the profile thickness of the nozzle ring. This end region of the nozzle shaft is preferably connected, i.e., welded and braced, on the inner side of the inner nozzle profile region. In this way, an extremely rigid connection is produced that can withstand high loads.

The profile of a nozzle ring usually consists of an inner profile region and an outer profile region that are respectively formed of steel plates. Connecting elements or connecting ribs and the like are provided in between for reinforcement purposes. In one preferred embodiment, the nozzle shaft therefore extends through the outer profile region or steel plate, as well as through the entire intermediate space between the outer and the inner profile region, before it is essentially abuts on or contacts the inner steel plate or inner wall. In this way, a particularly rigid connection can be easily produced. In this embodiment, the length of the inserted section of the nozzle shaft approximately corresponds to the profile thickness of the nozzle ring.

According to the present invention, the nozzle shaft preferably extends continuously from the interior of the hull to the nozzle ring. In other words, the nozzle shaft is connected to the nozzle ring with one end region and to the steering gear arranged in the interior of the hull with its other end. In this case, it is particularly advantageous to realize the nozzle shaft in one piece. Consequently, the inventive propeller nozzle does not comprise any pipe sockets or similar connecting pieces that are arranged on the nozzle ring and into which a nozzle shaft engages, but the inventive nozzle shaft rather extends from the hull into the interior of the nozzle ring and therefore requires no additional connecting means such as, for example, pipe sockets, flange plates or the like.

According to the invention, the hollow space of the nozzle shaft is not realized in the form of a conduit for conveying water or oil. Furthermore, no separate lines are provided in the interior of the nozzle shaft. Consequently, the nozzle shaft is used exclusively for supporting the nozzle ring and as a means for pivoting the nozzle ring and not as a hollow conduit body.

According to the invention, the nozzle shaft of the propeller nozzle can only be pivoted about its (vertical) longitudinal axis, but not pivoted or tilted about a horizontal axis or other axis. In other words, the nozzle shaft is respectively realized or arranged stationary and can only be pivoted about its own axis. The maximum pivoting angle, by which the nozzle shaft can be pivoted, is 180°, preferably no more than 140°, particularly no more than 90° or even no more than 60°. The inventive propeller nozzle therefore cannot be turned by 360°, particularly due to the stationary propeller.

The nozzle ring preferably encloses the propeller on all sides. The inventive propeller nozzle particularly does not consist of a tunnel rudder.

Due to the particularly rigid connecting point between the nozzle ring and the nozzle shaft, as well as the high torsional rigidity and flexural strength of the nozzle shaft according to the present invention, the propeller nozzle may be supported by means of the nozzle shaft only in one preferred embodiment and require no additional support, particularly no support in the sole piece in the lower region of the nozzle ring. In this way, the construction of the entire propeller nozzle is simplified because the lower bearing is eliminated. Furthermore, the propeller outflow is fluidically improved because the lower bearing in the sole piece needs to be connected to the hull and the flow against the sole piece extending out of the hull frequently generates unfavorable turbulences at this location.

It is furthermore preferred to provide at least two openings that are essentially arranged opposite of one another in the wall of the nozzle ring. The openings respectively extend through the entire wall and therefore consist of an inner and an outer region and a center region that connects these two regions to one another. In this way, ocean or sea water can flow from outside the nozzle ring into the interior of the nozzle ring through the at least two openings. This is advantageous with respect to preventing flow recirculations that could occur without such openings in the outer region of the propeller and directly downstream of the propeller when the nozzle ring is turned or pivoted. In order to prevent these recirculations in a particularly effective fashion, it is practical that the two openings are respectively arranged in a lateral area of the nozzle ring in the installed state. In this case, the remaining area of the nozzle ring is closed and not provided with any other opening. Referred to the flow direction, the at least two openings furthermore should preferably be arranged at the propeller or downstream thereof.

In order to additionally improve the stability and the flexural strength of the nozzle shaft, it is advantageous that the nozzle shaft is at least sectionally arranged and supported in a trunk pipe. The trunk pipe is rigidly connected to the structure of the watercraft and may be arranged completely within the watercraft or also partially outside thereof. It is particularly advantageous to respectively provide a bearing between the trunk pipe and the nozzle shaft in the upper and in the lower region of the trunk pipe. In this respect, it is preferred to provide at least one sliding bearing, particularly a cylindrical sliding bearing, between the trunk pipe and the nozzle shaft. The region of the nozzle shaft that faces the nozzle ring advantageously protrudes from the trunk pipe such that its end region can be connected to the nozzle ring. Trunk pipes basically are sufficiently known from the state of the art and typically realized in the form of a hollow cylinder, the inside diameter of which approximately corresponds to the outside diameter of the nozzle shaft.

It is generally preferred that the pivotable nozzle shaft is only supported on its outer surface and does not feature internal bearings or the like.

Figure 2:
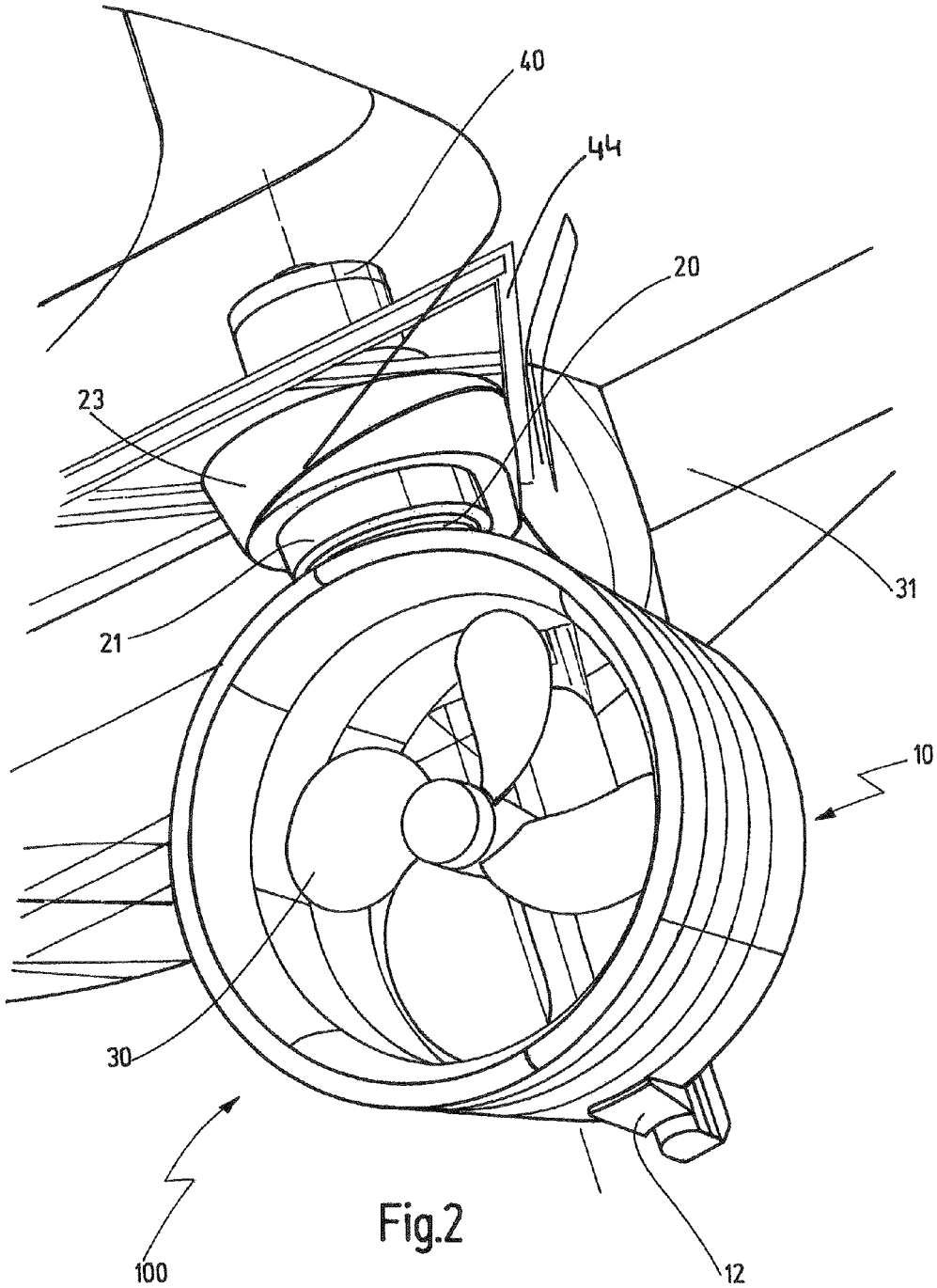
Figure 3:
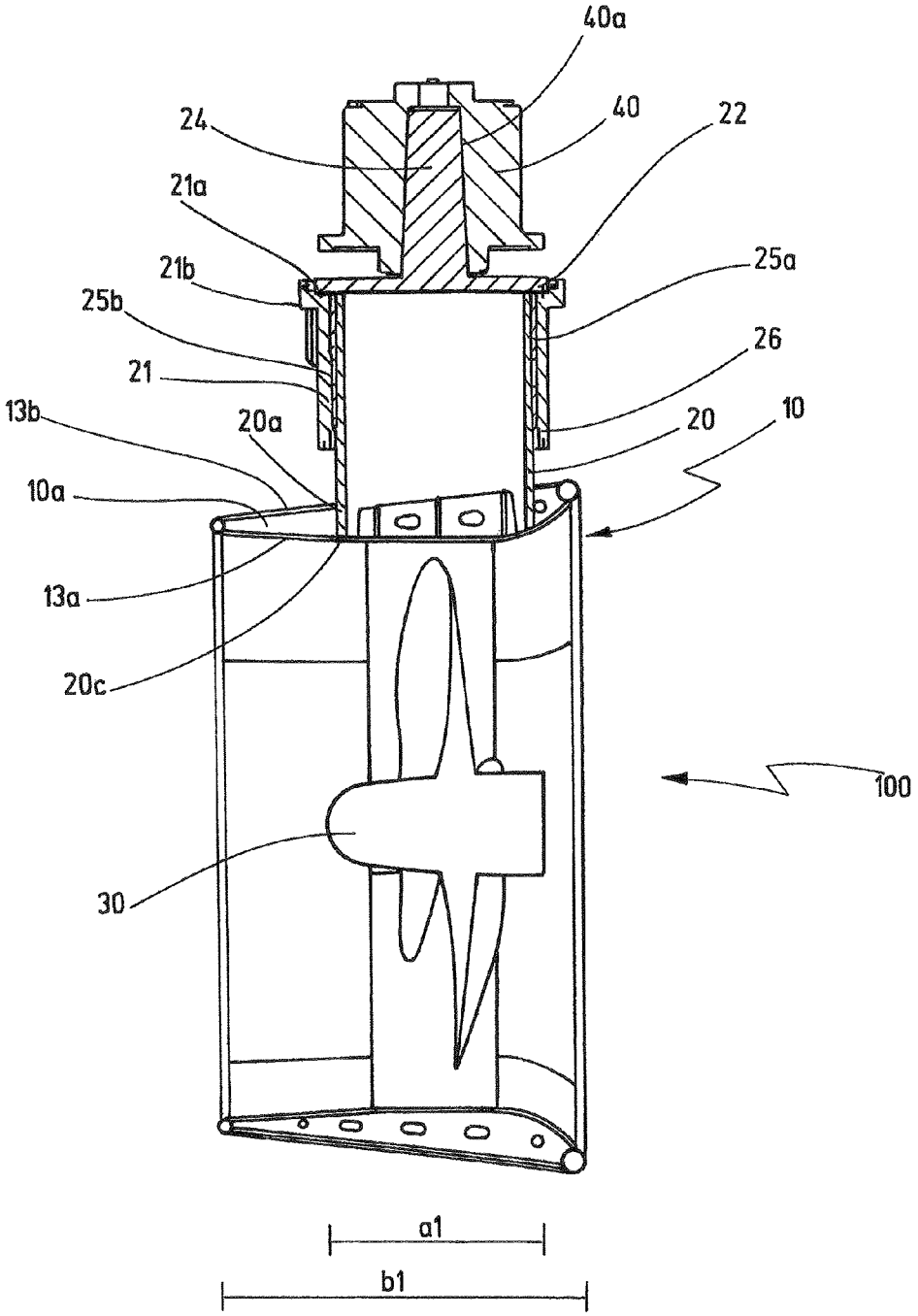
Figure 4:
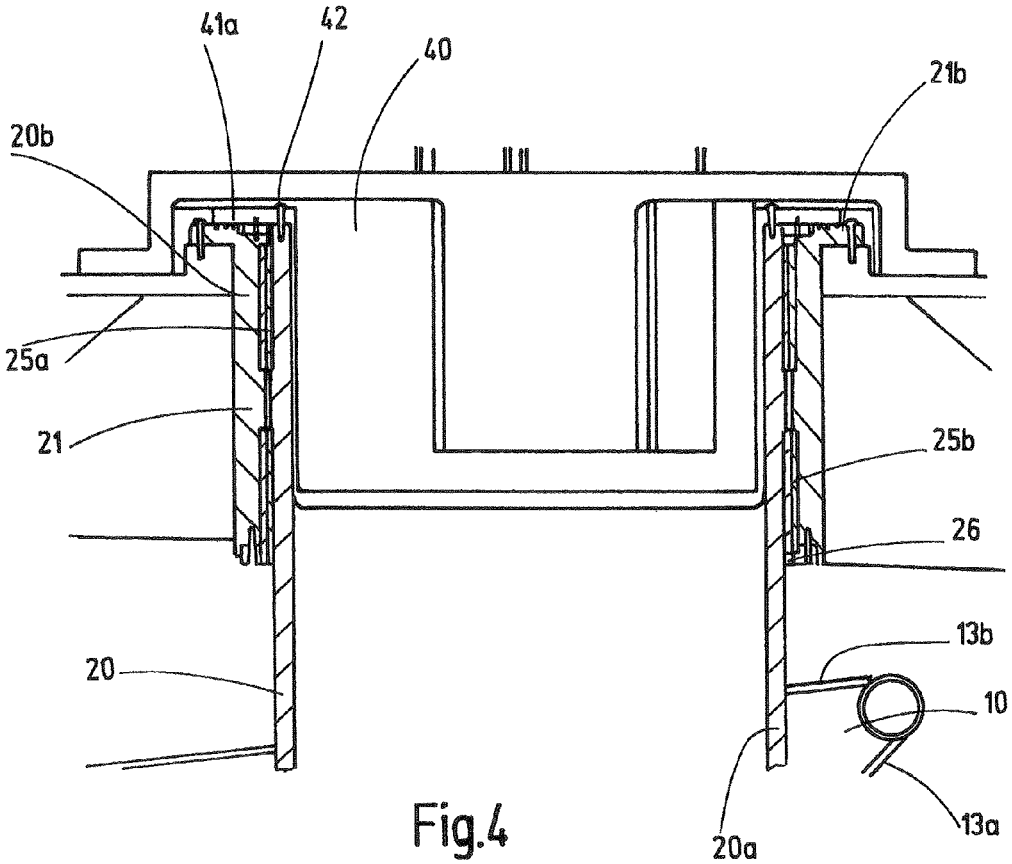
Figure 5:
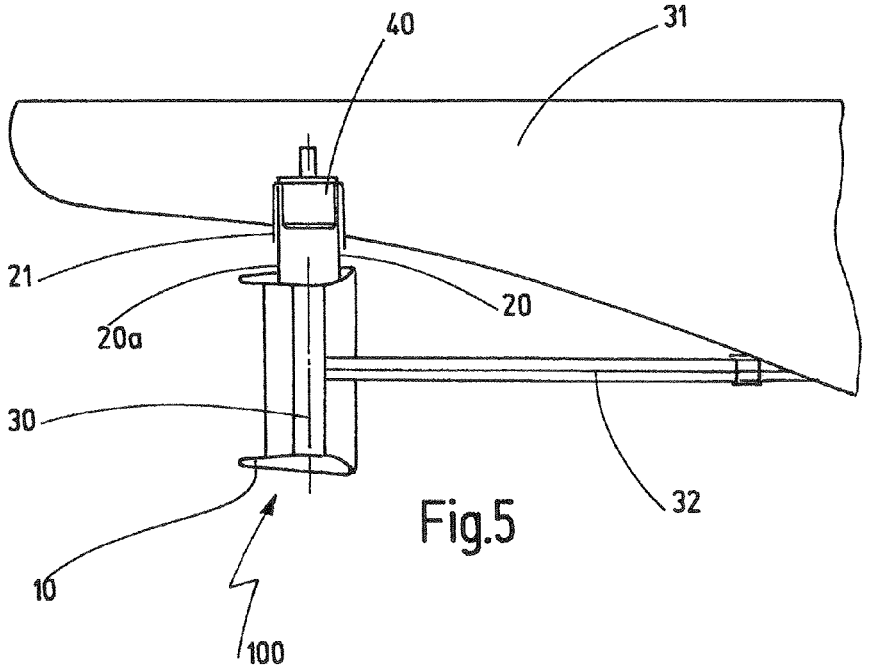

The invention is described in greater detail below with reference to the different embodiments that are illustrated in the drawings. In these schematic drawings:

FIG. 1 shows a perspective front view of a nozzle ring with an external pivot drive and a fin arranged on the rear side, FIG. 2 shows a perspective front view of a propeller nozzle with a fin arranged on the rear side and its arrangement on a hull of a twin-screw vessel, wherein the propeller shaft and the stern tube are not illustrated in this figure, FIG. 3 shows a longitudinal section through a propeller nozzle, FIG. 4 shows a longitudinal section through the upper end region of the nozzle shaft with a pivot drive arranged in the nozzle shaft, and FIG. 5 shows a schematic illustration of a hull stern section with propeller nozzle and propeller shaft.

FIG. 6 shows an exemplary prior art Kort nozzle that can be pivoted about the Rudder axis of a vessel and features a stationary propeller.

In the different embodiments illustrated in the figures described below, identical components are identified by the same reference symbols.

FIG. 1 shows a nozzle ring 10 of a propeller nozzle with a nozzle shaft 20 that is realized in the form of a hollow cylinder. The propeller was omitted in order to provide a better overview. In FIG. 2, the same nozzle ring 10 is illustrated in the installed state, i.e., in the state in which it is mounted on a vessel, such that the propeller 30 is arranged in the interior of the nozzle ring 10 in FIG. 2. The propeller shaft was omitted in FIG. 2 in order to provide a better overview. The hull 31 of the vessel is only illustrated in the region, in which the nozzle shaft is mounted thereon. Part of the hull 31 is also illustrated transparent such that a pivot drive 40 in the form of a blade-type steering gear that is seated on the nozzle shaft 20 and arranged in the interior of the hull 31, as well as its connecting construction 44 on the hull 31, are also partially visible. However, it would also be conceivable to use a pivot drive of any other design in this version.

On its end on the propeller outflow side, the nozzle ring 10 features a rigidly installed fin 11 that is arranged about centrally and extends from the upper wall region 10*a* of the nozzle ring 10 to the lower wall region 10*b* of the nozzle ring 10. The fin is rigidly connected to the nozzle ring 10. The fin basically may be realized stationary or also partially pivotable.

The propeller nozzle 100 does not feature a lower bearing and is only suspended or supported by means of the nozzle shaft 20 that is rigidly arranged in the upper wall region 10*a* of the nozzle ring 10 (see also FIG. 3). The nozzle shaft 20 in the form of a cylindrical pipe is at least partially supported within a trunk pipe 21 that is rigidly connected to the hull 31. The nozzle shaft 20 can be pivoted within the stationary trunk pipe 21. A mounting flange 22 of the nozzle shaft 20 is arranged in the upper end of the trunk pipe 21 that faces the hull 31 and protrudes over the nozzle shaft 20. This flange 22 in turn rests on the outward recess 21*b* of the trunk pipe 21.

In the illustration according to FIG. 2, the upper part of the trunk pipe 21 is covered by a cover or a skeg 23, respectively. The pivot drive 40 is seated on and rigidly connected to an arbor 24 that has the shape of a truncated cone and upwardly protrudes from the mounting flange 22 of the nozzle shaft 20 (see also FIG. 3). This arbor 24 with the shape of a truncated cone transmits the torque from the pivot drive 40 to the nozzle shaft 20. The nozzle shaft 20 protrudes from the trunk pipe 21 with its lower end region 20*a* that faces the nozzle ring 10.

FIG. 3 shows a longitudinal section through the propeller nozzle 100 illustrated in FIGS. 1 and 2. A fin is not illustrated in FIG. 3 in order to provide a better overview. The nozzle shaft 20 is supported in the trunk pipe 21 by means of an upper and a lower bearing 25*a*, 25*b*, both of which are realized in the form of sliding bearings. Seals 26 are furthermore provided between the trunk pipe 21 and the nozzle shaft 20 on the lower end of the trunk pipe 21. The lower end region 20*a* of the nozzle shaft 20 is inserted into the wall of the nozzle ring in the upper wall region 10*a*. The end face 20*c* of the nozzle shaft 20 abuts on the inner side 13*a* of the wall in this case. In the upper wall region 10*a*, the outer side 13*b* of the wall features a corresponding opening in the region of the nozzle shaft 20 such that this nozzle shaft can be inserted into the interior of the wall or of the nozzle ring 10, respectively. The nozzle shaft 20 is rigidly connected to the wall of the nozzle ring 10 by means of a welding seam on its end face 20*c*, as well as in the outer and inner surface area of the lower end region 20*a*. Since the lower end region 20*a* of the nozzle shaft 20 is inserted into the upper wall region 10*a*, the connection between the nozzle shaft 20 and the nozzle ring 10 is much more stable than in the connecting method known from the state of the art, in which the end face of a nozzle shaft of small diameter abuts on the outer side 13*a* of the wall or on a reinforcing plate or the like arranged thereon.

A flange plate or a mounting flange 22 is rigidly connected to the nozzle shaft and seated on the upper side of the nozzle shaft 20, wherein this flange plate or mounting flange protrudes over the nozzle shaft 20 and is supported in an axial bearing 21*a* provided in the trunk pipe 21 for this purpose. In this region, the trunk pipe 21 is realized with an outward recess 21*b* that accommodates the axial bearing 21*a*.

An arbor 24 with the shape of a truncated cone centrally protrudes from the mounting flange 22 and realized integrally with the mounting flange 22. The connection of the arbor 24 to the pivot drive 40 is realized in the form of a tapered connection, but all conventional types of connections for steering gears such as, e.g., clamping connections could conceivably also be used. In a tapered connection, the arbor 24 engages into a corresponding receptacle 40*a* of the pivot drive 40. The nozzle shaft 20 in the form of a cylindrical pipe has a comparatively large diameter, wherein the outside diameter a1 of the nozzle shaft 20 is greater than or equal to half the total length b1 of the nozzle ring 10. The nozzle shaft 20 is preferably realized in the form of a one-piece steel pipe.

FIG. 4 shows a longitudinal section through the upper end region 20*b* of the nozzle shaft 20 of another embodiment. In this embodiment, the nozzle shaft 20 is also supported in a trunk pipe 21 by means of two bearings 25*a*, 25*b*. Furthermore, the lower end region 20*a* of the nozzle shaft 20 is also inserted into the wall of the nozzle ring 10 through the outer side 13*b* of the wall. In contrast to the embodiment described above, the majority of the pivot drive 40 is arranged in the interior of the hollow nozzle shaft 20, particularly in the upper nozzle shaft region 20*b*, in the illustration according to FIG. 4. For this purpose, a supporting bearing in the form of a receptacle flange 41*a* is provided, wherein the receptacle flange is screwed to the pivot drive 40 in the form of a blade-type drive unit and features an opening, through which the pivot drive 40 protrudes into the nozzle shaft 20. The flange rests on the nozzle shaft 20 or its end face, respectively, and is rigidly connected thereto by means of a screw connection 42. The pivot drive 40 furthermore features a supporting flange 43 that abuts on the hull and introduces the torque into the hull 31. Due to the construction illustrated in FIG. 4, a majority of the space required for the pivot drive 40 is shifted into the interior of the hollow nozzle shaft 20 such that no extra space is required for the pivot drive 40 in the hull.

FIG. 5 shows a schematic illustration of an inventive propeller nozzle 100 that is installed on a vessel. The hull 31 of this vessel is only partially illustrated in the stern region. A trunk pipe 21 is provided on the hull 31 and protrudes from the hull 31, wherein a cylindrical nozzle shaft 20 is supported within said trunk pipe. A pivot drive 40 for driving the nozzle shaft is once again supported on the upper end of the cylindrical nozzle shaft 20. The lower end region 20*a* of the nozzle shaft 20 is rigidly connected to a nozzle ring 10, wherein the lower end 20*a* is inserted into the wall of the nozzle ring 10 and rigidly welded to the wall. Furthermore, the propeller 30 arranged in the interior of the nozzle ring 10, as well as the propeller shaft 32 leading from the propeller 30 into the interior of the hull 31, are also schematically indicated in this figure.

The invention claimed is:

1. A nozzle shaft for pivotable Kort propeller nozzles with stationary propeller for watercraft comprising:

a nozzle shaft having a hollow body of a constant diameter over its entire length in an axial direction;

wherein a blade-type pivot drive for the nozzle shaft is at least partially arranged inside of the nozzle shaft and in an end region of the nozzle shaft; and wherein outside dimensions of the pivot drive correspond essentially to inside dimensions of the nozzle shaft.

2. The nozzle shaft according to claim 1, wherein the nozzle shaft is manufactured of steel.

3. The nozzle shaft according to claim 1, including an arbor provided on an end region of the nozzle shaft in order to produce a connection with the pivot drive.

4. The nozzle shaft according to claim 3, wherein the arbor comprises an axial bearing for axially supporting the nozzle shaft.

5. The nozzle shaft according to claim 1, wherein the nozzle shaft has a diameter between 75 cm and 125 cm.

6. The nozzle shaft according to claim 5, wherein the nozzle shaft has a diameter between 90 cm and 110 cm.

7. The nozzle shaft according to claim 1, wherein the wall thickness of the nozzle shaft lies between 2 cm and 8 cm.

8. The nozzle shaft according to claim 1, wherein the wall thickness of the nozzle shaft lies between 3 cm and 5 cm.

9. The nozzle shaft of claim 3, wherein the arbor is detachably connected to the nozzle shaft.

10. The nozzle shaft according to claim 1, wherein the nozzle shaft has a diameter between 60 cm and 150 cm.

11. The nozzle shaft according to claim 1, wherein the wall thickness of the nozzle shaft lies between 1 cm and 10 cm.

12. A propeller nozzle for watercraft with a stationary propeller and a nozzle ring that shrouds the propeller, comprising:

a nozzle shaft for pivoting the nozzle ring, wherein the nozzle shaft is realized in the form of a cylindrical pipe;

wherein an end region of the nozzle shaft that faces the nozzle ring is rigidly connected to the nozzle ring by means of welding;

wherein an end region of the nozzle shaft that faces the nozzle ring is inserted into a wall of the nozzle ring; and wherein the nozzle shaft is at least sectionally arranged and supported in a trunk pipe, wherein the region of the nozzle shaft that faces the nozzle ring protrudes over the trunk pipe.

13. The propeller nozzle according to claim 12, wherein the propeller nozzle is supported by the nozzle shaft only and does not feature any other support.

14. The propeller nozzle according claim 12, including at least two openings in the wall of the nozzle ring arranged opposite of one another.

15. The propeller nozzle according to claim 12, wherein the nozzle shaft has a constant diameter over its entire length in an axial direction, wherein a blade-type pivot drive for the nozzle shaft is at least partially arranged inside of the nozzle shaft and in an end region of the nozzle shaft, and wherein outside dimensions of the pivot drive correspond essentially to inside dimensions of the nozzle shaft.

16. The propeller nozzle of claim 12, wherein the end region of the nozzle shaft that faces the nozzle ring abuts on an inner wall of the nozzle ring with its end face.

17. A watercraft, characterized in that it comprises a propeller nozzle for watercraft, with a stationary propeller and a nozzle ring that shrouds the propeller, comprising:

a nozzle shaft for pivoting the nozzle ring, wherein the nozzle shaft is realized in the form of a cylindrical pipe;

wherein an end region of the nozzle shaft that faces the nozzle ring is rigidly connected to the nozzle ring by means of welding;

wherein an end region of the nozzle shaft that faces the nozzle ring is inserted into a wall of the nozzle ring; and wherein the nozzle shaft is at least sectionally arranged and supported in a trunk pipe, wherein the region of the nozzle shaft that faces the nozzle ring protrudes over the trunk pipe.

* * * * *